US007647990B2

(12) United States Patent
Tessari et al.

(10) Patent No.: US 7,647,990 B2
(45) Date of Patent: Jan. 19, 2010

(54) METHOD FOR DRILLING WITH A WELLBORE LINER

(75) Inventors: Robert M. Tessari, Calgary (CA); Tommy M. Warren, Coweta, OK (US); Barry J. Tate, Strathmore (CA)

(73) Assignee: Tesco Corporation, Calgary, Alberta (CA)

( * ) Notice: Subject to any disclaimer, the term of this patent is extended or adjusted under 35 U.S.C. 154(b) by 273 days.

(21) Appl. No.: 11/461,248

(22) Filed: Jul. 31, 2006

(65) Prior Publication Data

US 2007/0175665 A1 Aug. 2, 2007

Related U.S. Application Data

(60) Provisional application No. 60/596,594, filed on Oct. 5, 2005.

(51) Int. Cl.
*E21B 7/20* (2006.01)

(52) U.S. Cl. ..... 175/171; 175/57; 175/257

(58) Field of Classification Search ..... 175/57, 175/61, 65, 257, 171
See application file for complete search history.

(56) References Cited

U.S. PATENT DOCUMENTS

| | | | | |
|---|---|---|---|---|
| 2,214,226 | A | 9/1940 | English | |
| 5,253,708 | A | 10/1993 | Alexander | |
| 5,957,225 | A | 9/1999 | Sinor | |
| 6,158,531 | A | 12/2000 | Vail, III | |
| 6,263,987 | B1 | 7/2001 | Vail, III | |
| 6,543,552 | B1 | 4/2003 | Metcalfe et al. | |
| 6,655,463 | B2 | 12/2003 | Salies | |
| 6,729,393 | B2 | 5/2004 | Vincent et al. | |
| 7,004,264 | B2 | 2/2006 | Simpson et al. | |
| 7,013,997 | B2 | 3/2006 | Vail, III | |
| 2002/0166665 | A1 | 11/2002 | Vincent et al. | |
| 2003/0217865 | A1 * | 11/2003 | Simpson et al. | 175/57 |
| 2004/0003944 | A1 | 1/2004 | Vincent et al. | |
| 2004/0026126 | A1 | 2/2004 | Angman | |
| 2004/0108142 | A1 | 6/2004 | Vail, III | |
| 2004/0118560 | A1 | 6/2004 | Johnson et al. | |
| 2004/0123984 | A1 | 7/2004 | Vail, III | |

(Continued)

FOREIGN PATENT DOCUMENTS

| | | |
|---|---|---|
| WO | 2005040547 | 5/2005 |

OTHER PUBLICATIONS

L.A. Sinor et al. ; Rotary Liner Drilling for Depleted Reservoirs, Mar. 3-6, 1998, pp. 879-888; IADC/SPE 39399, Texas, USA.

(Continued)

*Primary Examiner*—David J Bagnell
*Assistant Examiner*—Brad Harcourt
(74) *Attorney, Agent, or Firm*—Bracewell & Giuliani LLP

(57) ABSTRACT

A method for drilling with a liner includes: providing a liner string including an upper portion extending towards surface and a lower portion; drilling to a depth with the liner string; disconnecting the upper portion from the lower portion; pulling the upper portion from the well; and leaving the lower portion in the well to line the wellbore. A drilling assembly for drilling a borehole with a borehole liner includes: an upper liner string; a lower liner string including an upper end and a lower end; a releasable connector connecting the lower liner string to the upper liner string; and a drilling assembly connectable at the lower end of the lower liner string.

19 Claims, 3 Drawing Sheets

U.S. PATENT DOCUMENTS

| | | | | |
|---|---|---|---|---|
| 2004/0129456 | A1 | 7/2004 | Vail, III | |
| 2004/0244992 | A1 | 12/2004 | Carter et al. | |
| 2004/0245020 | A1 | 12/2004 | Giroux et al. | |
| 2004/0256157 | A1 | 12/2004 | Tessari et al. | |
| 2005/0217858 | A1 | 10/2005 | Galloway et al. | |
| 2005/0263292 | A1 | 12/2005 | Braddick | |
| 2005/0263294 | A1 | 12/2005 | Braddick | |
| 2006/0118336 | A1 | 6/2006 | Rogers et al. | |
| 2006/0124317 | A1 | 6/2006 | Telfer | |
| 2006/0219441 | A1 | 10/2006 | Telfer | |
| 2006/0243455 | A1 | 11/2006 | Telfer et al. | |
| 2006/0283633 | A1* | 12/2006 | Benge et al. | 175/57 |
| 2007/0034408 | A1* | 2/2007 | Benzie et al. | 175/57 |
| 2007/0039737 | A1 | 2/2007 | Telfer | |
| 2007/0107911 | A1* | 5/2007 | Miller et al. | 166/380 |

OTHER PUBLICATIONS

Schematic of Proposed Casing Drilling Assembly—May, 2002 The Tesco liner Casing Drilling assembly—Directional BHA illustrates a design and testing project performed in Aberdeen, Scotland and Calgary, Alberta, Canada during 2002. The 5-1/2" 17ppf casing (the liner) is secured by a liner circulating and backoff tool to a string of 5-1/2" 21.9ppf drill pipe. The drill pipe has a 4-1/2 inner diameter so as to allow retrieval of the bottom hole assembly through the drill pipe. After retrieval of the bottom hole assembly and cementing and setting the liner hanger, the drill pipe is retrieved. This work was performed to interest Shell Oil Co. in utilizing liner Casing Drilling for certain wells in the North Sea. The liner Casing Drilling for Shell Oil Co. was never performed. Applicant submits that the project does not constitute prior art.

* cited by examiner

METHOD FOR DRILLING WITH A WELLBORE LINER

FIELD

The invention relates to a method for wellbore drilling and, in particular, a method for drilling a wellbore with a wellbore liner.

BACKGROUND

Methods for drilling with casing have been developed wherein drilling tools are retrievable through the casing, which acts as the drill string. Much research has also been dedicated to exploring ways to develop a liner drilling technology based on the conventional method of running a liner on drillpipe. There are significant technical and economic hurdles to overcome to develop a retrievable liner drilling system using drillpipe as the means of driving the liner. However, a liner drilling system based on using the already developed Casing Drilling tools® would be much more economical to develop and provide to the market.

There is a relatively large usage of liners in drilling programs, particularly those in lateral wellbores and for deepwater wells where the pressure gradient is very steep. In fact, all casing strings in deepwater wells must be run as a "liner" because the top of the casing is located at the sea bed which may be several thousand feet below the rig floor.

A prior art assembly for liner drilling is shown schematically in FIG. 1. Prior art liner drilling systems normally utilize a drillable bit 10 attached to the bottom of the liner 12 and a liner hanger 14 to attach the top of the liner to drillpipe 16. The drillpipe then extends back to the surface 17. This assembly is used to drill a wellbore 18 to accommodate the liner. Drilling fluid circulation and drillstring rotation is provided to the liner through the drillpipe. Once the liner is drilled to the desired depth, for example to a point where the liner has penetrated the formation, the liner hanger is activated to support the weight of the liner in the wellbore and the drill pipe is detached from the liner. In some cases a liner hanger is not used and the top of the liner is left unsupported. In other cases the top of the liner is expanded to engage the wellbore open hole or liner in which it is installed. The liner may be cemented in place before the drillpipe is detached from the liner hanger. Once the drillpipe is withdrawn from the well, a new drilling assembly may be made-up to the drillpipe and run into the well to drill through the "drillable" bit that remains attached to the liner.

There are a number of disadvantages of this method of liner drilling. First, there is no convenient way to replace the drill bit in cases where it wears out before reaching the desired liner setting depth. Replacing the bit requires the entire liner and drillpipe string be tripped out of the well and this defeats the advantages of drilling with the liner. There is no ability to drill directional wells with the system because it is not possible, to recover the expensive directional drilling and formation logging tools that are required to drill directional wells. The drilled hole must be no larger than the ID of the previously set casing because the "drillable bit" is of a fixed diameter. This may induce undesirable high circulating fluid pressure losses in the annulus.

SUMMARY OF THE INVENTION

In many situations where a liner is normally used in the casing program for a well, it would be advantageous to drill with the liner as a portion of the drillstring.

In one aspect of the present invention, there is provided a method for drilling with a liner, the method comprising: providing a liner string including an upper portion extending towards surface and a lower portion; drilling to a depth with the liner string; disconnecting the upper portion from the lower portion; pulling the upper portion from the well; and leaving the lower portion in the well to line the wellbore.

According to another aspect of the present invention, there is provided a drilling assembly for drilling a borehole with a borehole liner, the drilling assembly comprising: an upper liner string; a lower liner string including an upper end and a lower end; a releasable connector connecting the lower liner string to the upper liner string; and a drilling assembly connectable at the lower end of the lower liner string.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

In the following discussion, the term liner is used to encompass both those tubulars generally known as casing, which are used to form wellbore liner strings extending to surface and those tubulars generally identified as liners, which may be identical to casing, but do not extend to surface.

Figure 1:
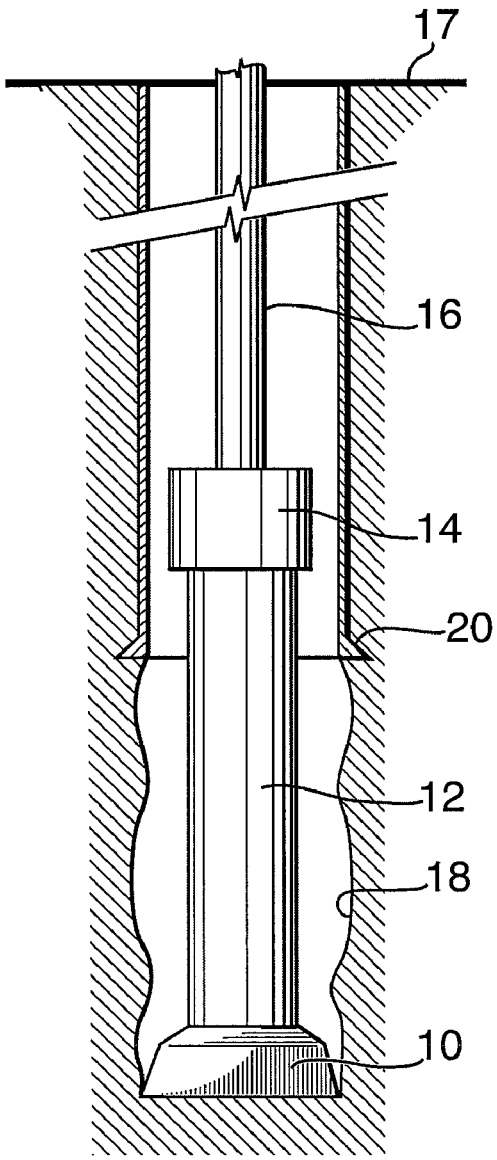
FIG. 1 PRIOR ART
FIG. 1 is a schematic view of a prior art assembly for drilling with a borehole liner.
Figure 2:
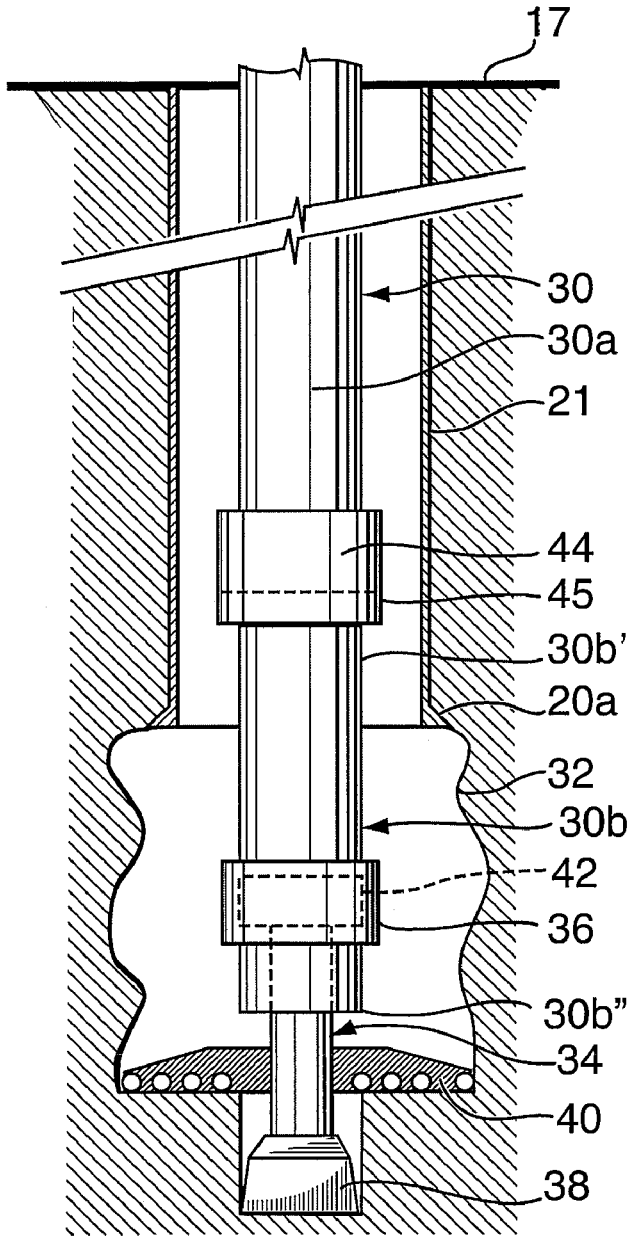
FIG. 2 is a schematic view of an assembly according to one aspect of the present invention in an operational setting for drilling with a borehole liner according to another aspect of the present invention.

A drilling assembly according to the present invention is shown schematically in FIG. 2. The invention relates to a method of drilling with a string of liner tubulars substantially from surface 17 and an assembly to carry out the method. The string of liner tubulars can act as the drill string and a portion of the string can remain downhole after drilling to line the borehole formed. In particular, the liner string 30 may include an upper portion 30*a* and a lower portion 30*b*. The upper portion of the liner string may extend from upper end 30*b*' of the lower portion towards surface 17 and possibly entirely to the surface. Surface 17 may include a land operation or an offshore rig surface.

Drilling may proceed using the liner string including upper portion 30*a* connected above lower portion 30*b*. If upper portion 30*a* extends fully to surface, drilling may proceed by manipulating the upper portion such as, for example, rotating, reciprocating, adding tubulars thereto, etc. Drilling may proceed by any of various systems including, for example, a rotary system, by downhole motor drive, by air drilling, impact, etc.

Once the liner is drilled in to a desired depth, the upper portion of the liner string may be disconnected from the remainder of the string and pulled from the well. Lower portion 30*b* of the liner string remains in the well and becomes the wellbore liner.

In one embodiment, the lower portion of the liner string may be set in the wellbore 32 in order for it to act and remain in place as the wellbore liner.

It is to be understood that the order of various steps may vary depending on the actual processes and equipment used. For example, in one embodiment, an operation to set the lower liner portion in the wellbore may occur at the same time, for example, via the same process as that used to disconnect the upper portion from the lower portion. In other embodiments, the steps of setting the liner lower portion 30*b* in the wellbore may be discreet from the step of disconnecting the upper portion from the lower portion and such steps may occur before or after each other. The upper portion of the liner string may be manipulated at surface during disconnection and/or liner setting, if such manipulation is necessary for, or to facilitate, the process.

The desired depth may be determined by various methods, as will be appreciated. In one embodiment, the desired depth is determined with consideration as to the depth of upper end 30*b*' of the lower liner string. In particular, it may be desired to discontinue drilling when the upper end 30*b*' reaches a desired position for setting the liner string in the wellbore such as for example at the point 20*a* of the previously set liner 21, often termed the casing point.

Upper portion 30*a* of the liner string and lower portion 30*b* of the liner string may be formed of a plurality of similar tubulars. However, for various reasons a plurality of different tubulars may be used to form the entirely or lengths of each of the upper and lower portions of the liner string. Thus the inner and outer diameters may vary along the liner string. However, the tubulars of the upper and lower portions of the liner string may be selected to allow the conveyance of a retrievable tool through both upper portion 30*a* and lower portion 30*b* of the liner string. As such the drift diameter of the upper portion 30*a* may be selected to be at least as large as the drift diameter of the lower portion 30*b*. In one embodiment, the upper liner string and the lower liner string may have a similar drift diameter and in one embodiment may be formed of the same type of tubulars throughout.

Using the present method and assembly, in one embodiment, readily available retrievable tools, such as Casing Drilling® tools available from Tesco Corporation, can be tripped between lower portion 30*b* and surface 17*a* entirely through the inner diameter of the liner string. Tripping of tools in this way permits tool retrieval without disconnecting the upper portion from the lower portion of the liner string and without pulling the liner string out of the hole.

Figure 3:
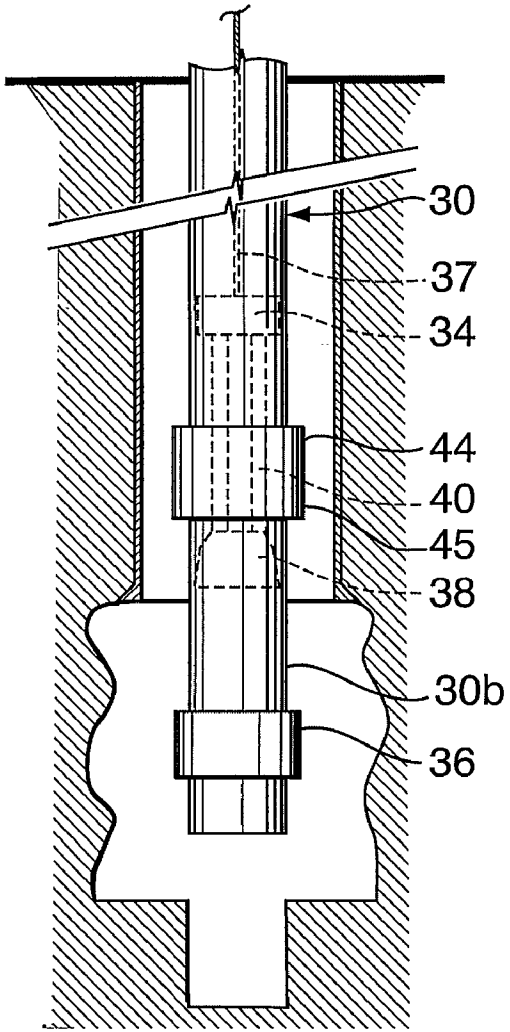

For example, while a non-retrievable drilling assembly may be used as in the prior art drillable bit, in one embodiment a through-tubing retrievable bottom hole assembly 34 may be used. In such an embodiment, lower portion 30*b* of the liner string may be made up with a nipple 36 near its lower end 30*b*'. The nipple, which may for example be a no-go type nipple, a profile nipple, etc., is formed to receive and releasably retain the particular retrievable drilling assembly selected to be used with the assembly for liner drilling. Of course, the nipple may be eliminated or replaced if the drilling assembly is retained by other means in the liner string. The retrievable drilling assembly may be as simple as including a pilot bit 38 sized to pass through the liner and an underreamer 40 sized or collapsible to pass through the liner string and sized in an operational configuration to drill the final borehole diameter. This final hole diameter is large enough to accommodate the liner and may, if desired, be larger than the ID of previously set casing 21. The retrievable assembly includes a mechanism 42 to lock it to the liner string, for example into nipple 36, in such a way that it can be unlocked and retrieved, as shown in FIG. 3, from the liner by using a wireline 37 or by reverse circulating it from the bottom of the liner. The retrievable assembly may include any number of other components such as, for example, directional drilling tools, formation logging tools, coring tools, and fishing tools. By tripping assembly 34 to surface, these components, the pilot bit and the underreamers, may, after the drilling operation, be recovered and during a drilling operation be, inspected, replaced and/or changed, to maintain, improve or change the function of the drilling assembly.

Upper portion 30*a* of the liner string will generally be connected to the upper end 30*b*' of lower portion 30*b* by a releasable connector 44 of some sort to facilitate, and to select the position of, disconnection of the upper liner string from the lower liner string, when such disconnection is desired. Of course, it will be appreciated that liner strings are often formed from a series of liner tubulars connected end to end by threaded connections. Releasable connector 44 is selected to disconnect preferentially over any of the numerous liner tubular to liner tubular connections forming the liner strings. A releasable connector may include, for example, any of a coarse right-hand threaded connection, a torque limited right-hand threaded connection, a shear system, lock dogs, J-locks, etc. such as may be available in various back-off (also called on-off) tools. Selection of the releasable connector may, therefore, be made with consideration as to procedure which is desired to be used to effect the disconnection of the upper liner from the lower liner. However, care may be taken to avoid the use of a releasable connector that overly limits the ID of the liner string. In particular, it is desirable that downhole tools remain at least retrievable and possibly also deployable through the releasable connector. Also, as will be appreciated, any releasable connector must be capable of withstanding the rigors of drilling, such as fatigue and torque, and possibly also of conducting the weight of the lower portion to the upper portion.

The liner may be set in the well by various procedures, some of which require a liner setting device 45. A liner may be set, for example, using a liner hanger. Alternately, an expandable liner section may be used instead of a liner hanger. In yet another embodiment, the lower portion may be set simply by being disconnected from the upper portion and left in the well. A cementing procedure may alternately or in addition be employed to set the lower portion in the borehole.

In one embodiment, for example, a liner hanger may be used at the top of lower portion to support the weight of the lower portion of the liner once it is left in the wellbore. This liner hanger may be of any of various designs. Liner hangers are available, for example, that include a packer element, slips, a mechanically expandable assembly, and combinations thereof. As noted previously with respect to the releasable connector, any liner hanger may have a full opening ID, for example no less than the drift diameter of lower portion 30*b*, in order to be able to retrieve a drilling assembly therethrough.

In another embodiment, the liner may be set in the wellbore by use of an expandable section. In such an embodiment, a section of the liner is expanded, as by use of a mandrel, hydraulic expansion or an explosion, to force the material of the liner into an interference mechanical fit to the previously set casing in the wellbore. When compared to a liner hanger, the use of an expandable section may eliminate the possibility of loose parts being lost downhole, may provide a good flow area around the outside prior to expansion, may provide a full opening bore, and may provide a good mechanical and pressure seal at the top of the set liner.

In some embodiments, as shown, the releasable connector may have a liner-setting functionality. For example, the releasable connector may include a liner hanger component (as shown), an expandable section, etc. For example, one releasable connector includes a mechanical connection that is disconnected by an expansion operation that sets an expandable liner hanger.

Alternately, neither a liner hanger nor an expandable section may be used if it is possible to set the liner in the hole without the use of same. In certain types of wells, such as for example, a horizontal well, it may not be necessary drive the liner into engagement with the wellbore. In such an embodiment, upper portion 30*a* of the liner string may be disconnected from lower portion 30*b* and the lower portion may be simply left in the well. This may be achieved by use of a back-off tool.

The lower portion of the liner string may, alternately or in addition, be set in the wellbore by use at least in part of cementing. In such an embodiment, the lower liner portion may, if necessary, be equipped with a sub for accepting a cement float and/or a wiper plug. In one embodiment, nipple 36 serves a dual purpose to also catch and retain cementing equipment.

Figure 6:
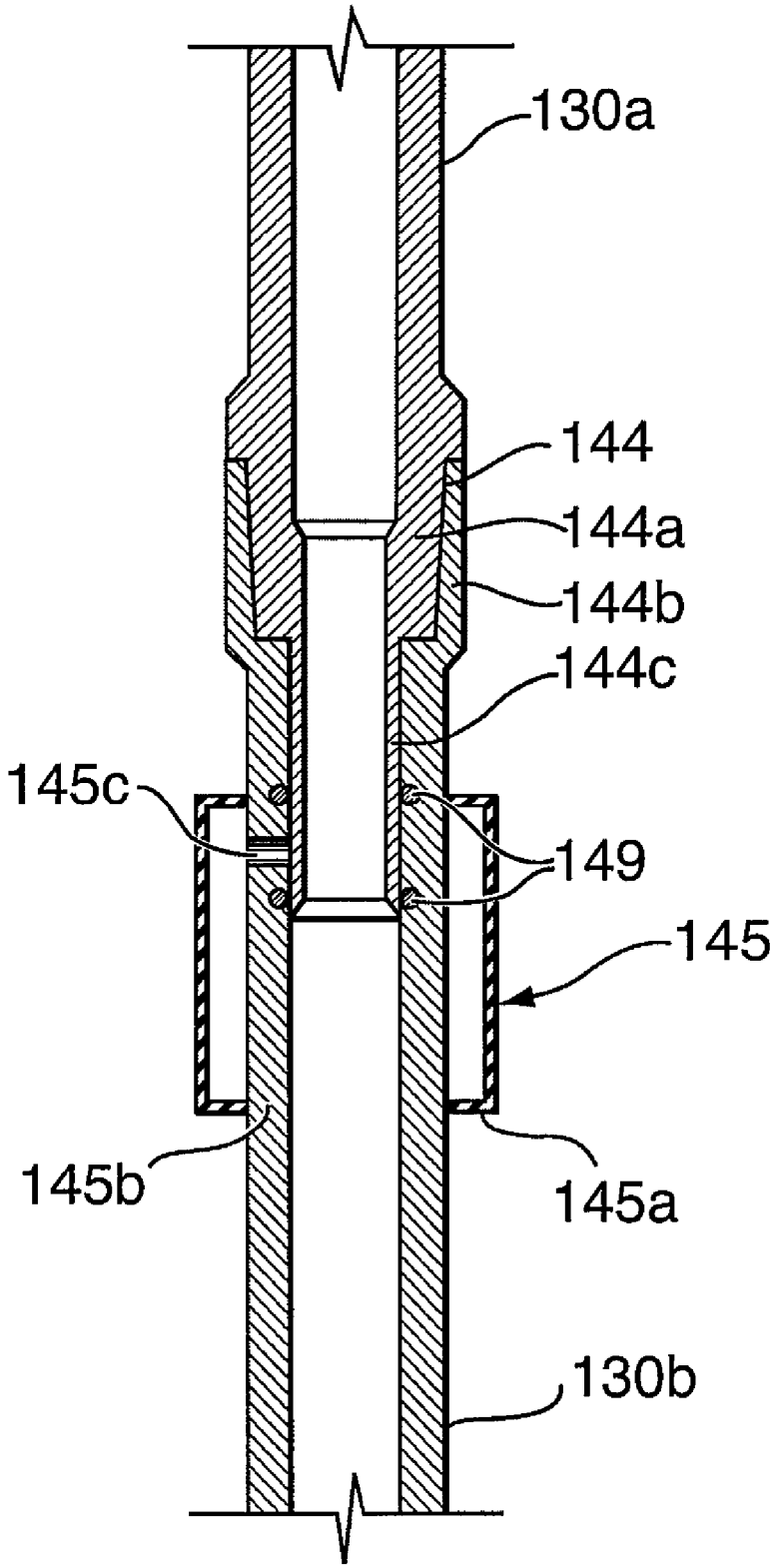
FIG. 6 shows a schematic sectional view through a tool installed in a liner drilling string according to another embodiment of the present invention.

With reference to FIG. 6, one example of a combination tool is shown including a releasable connector, in this embodiment formed as an on-off tool 144 with a rotating release configuration acting between a first part 144*a* and a second part 144*b*, and a liner setting device, in this embodiment shown as an inflatable packer 145. In a system for drilling with a liner including an upper section 130*a* and a lower section 130*b*, the combination tool may be installed therebetween to connect the upper section and the lower section while drilling, but to allow them to be separated after drilling. The combination tool permits actuation of the packer to be controlled by actuation of the on-off tool. In this illustrated embodiment, packer 145 includes an outer inflatable member 14*a* mounted on a tubular 145*b*. Tubular 145*b* includes at least one packer inflation port 145*c* through its wall providing fluid communication, when open, between the inner bore of the tubular and inflatable member 145*a*. On-off tool 144 may include a sleeve 144*c* that extends into the bore of packer tubular 145*b* a sufficient distance to cover port 145*c*, when first part and second part are fully connected. In this embodiment, sleeve 144*b* is formed to be moveable to expose port 145*c* on the inner bore of tubular 145*b* when the first part and the second part are partially released. For example, such forming may be by selecting the length of sleeve to extend over the port in a closed port position, but to expose the port when the first part and second are partially released. Alternately, the sleeve may be provided with at least one port positioned to be out of alignment with packer inflation port 145*c* in the closed port position but aligned with port 145*c* when the first part and second are partially released. Seals 149 may be provided to act against fluid leakage between the sleeve and the inner bore of tubular 145*b*.

In use of the combination tool, once the liner 130*a*, 130*b* is drilled to its terminal point, the weight of lower section 130*b* of the liner may be set down to be supported on the bit end (not shown) so that on-off tool 144 is at a neutral weight position. Left hand torque may then be applied to the liner upper section to cause the on-off tool to unthread sufficiently to open packer inflation port 145*c*, but insufficiently to allow first part 144*a* and second part 144*b* to part so that upper section 130*a* and lower liner section 130*b* remain connected. The liner string is then picked up sufficiently to hold at least a portion of the string in tension. Pressure may then be applied with any convenient fluid (mud, water, cement) to inflate and set the packer in order to provide an annular seal at the top of lower liner section 130*b* and to support a portion of the weight of that liner section. Upper section 130*a* of the liner may then be rotated again to the left, while lower liner is held stationary by the action of packer 145, to completely disconnect the parts 144*a*, 144*b* of the on-off tool and thereby separate the upper section from the lower section. The upper section may then be removed from the well.

Figure 5:
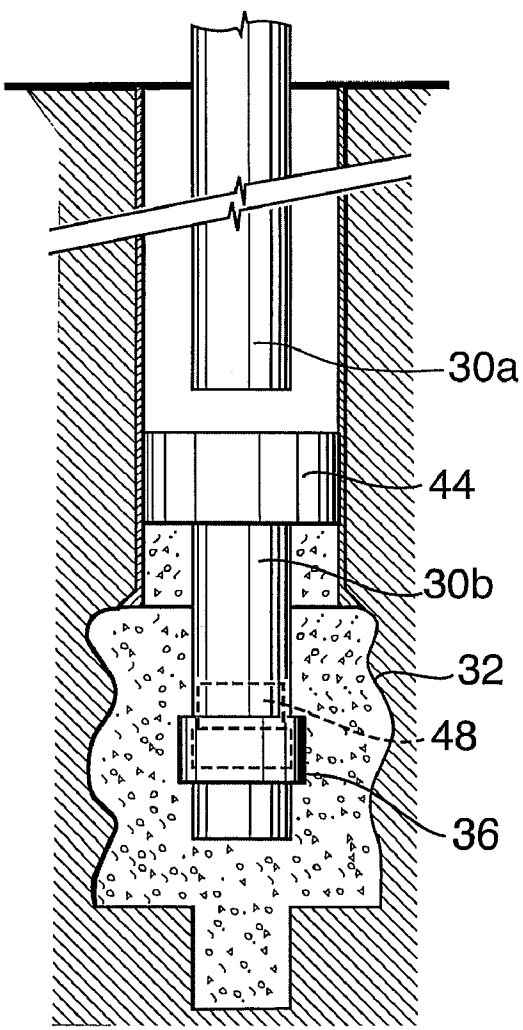
FIGS. 3 to 5 show further schematic views of one embodiment of a method according to the present invention following from FIG. 2.
Figure 4:
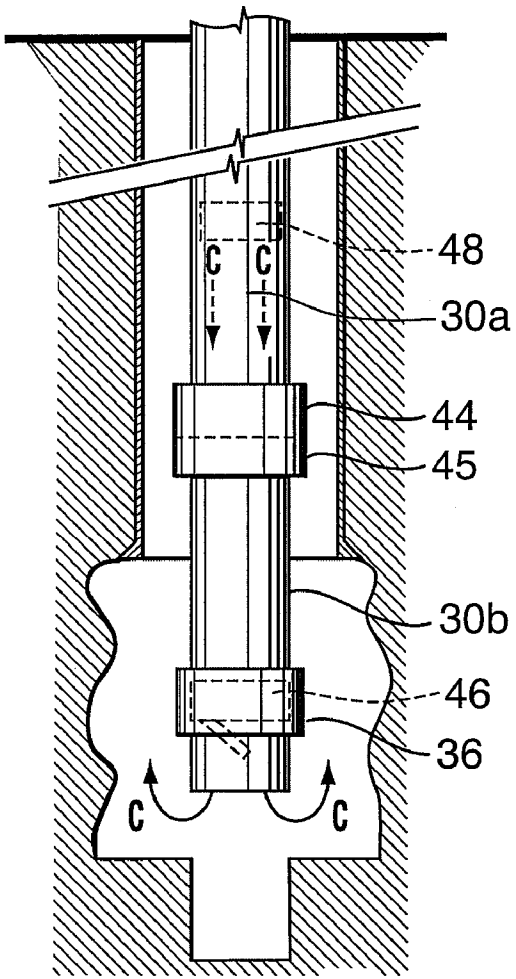

In one embodiment, for example, after the liner is drilled to the desired depth (FIG. 2), the drilling tools 34 may be retrieved through liner string 30 (FIG. 3) including passing through the lower portion of the liner string and the upper portion of the liner string to surface. Thereafter, as shown in FIG. 4, a pump-down or wireline conveyed cementing float 46 may be installed near bottom end 30*b*' of the lower portion of the liner string, for example retained in nipple 36. The liner may then be cemented (arrows C) in place and the cement flushed from the liner with a cement displacement wiper plug 48. Then, as shown in FIG. 5, the liner hanger, shown herein as a component of releasable connector 44, may then be set and the upper liner portion 30*b* may be disconnected, as provided by releasable connector 44, from the upper end of lower liner portion 30*b*.

Once upper portion 30*a* is disconnected from the top of the liner, it is tripped out.

According to the present method and with reference to prior art terminology, therefore, the upper liner portion 30*a* may be considered as the drill string, but formed of liner tubulars rather than drill pipe, and the lower liner portion 30*b* may be considered the actual final wellbore liner.

In one embodiment, the tubulars of the upper portion, after being used as a drill string and retrieved to surface, may be used on another well. In one possible embodiment, at least some of the liner tubulars used as the upper portion in one operation can be used as a lower portion in a subsequent hole to control the degree of wear of any tubulars used eventually as the permanent wellbore liner.

This drilling process provides all of the advantages of drilling with a full liner string, yet leaves only a liner in the wellbore as is advantageous in many drilling programs and, for example, as may be required for deepwater drilling programs where all the casing strings are run as "liners" in the sense that the casing string is terminated at the sea floor which may be several thousand feet below the drilling rig.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope of the appended claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public. No element is to be construed under the provisions of 35 USC 112, sixth paragraph, unless the element is expressly recited using the phrase "means for" or "step for".

We claim:

1. A method for drilling with a liner, the method comprising:

providing a liner string including an upper portion extending towards surface and a lower portion, the upper portion being connected to the lower portion by a releasable connector;

connecting a drilling assembly to a distal end of the lower portion;

drilling to a depth with the liner string and the drilling assembly;

retrieving the drilling assembly to the surface through the upper and lower portions and the releasable connector of the liner string;

manipulation the releasable connector to disconnect the upper portion from the lower portion;

pulling the upper portion from the well; and leaving the lower portion in the well to line the wellbore.

2. The method of claim 1 further comprising providing the releasable connector with a liner hanger and attaching the liner hanger to a lower end portion of a string of casing previously installed in the wellbore; and wherein the liner hanger is contained within the liner string during the step of drilling to a depth with the liner string and the drilling assembly.

3. The method of claim 1 wherein the upper portion of the liner string and the releasable connector has a drift diameter at least as large as a drift diameter of the lower portion of the liner string so as to enable retrieving the drilling assembly to the surface through the upper and lower portions of the liner string.

4. The method of claim 1 further comprising cementing the lower portion in the wellbore before manipulating the releasable connector to disconnect the upper portion from the lower portion.

5. The method of claim 1 further comprising conveying a cement float through the upper and lower portions and the releasable connector of the liner string from the surface and cementing the lower portion of the liner string in the wellbore.

6. The method of claim 1 further comprising providing the lower portion of the liner string with a liner hanger and setting the liner hanger when disconnecting the upper portion of the liner string from the lower portion.

7. The method of claim 1 further comprising after pulling the upper portion of liner string to surface, reusing tubulars of the upper portion of the liner string in a liner string of a subsequent well.

8. The method of claim 1 wherein the step of manipulating the releasable connector to disconnect the upper portion from the lower portion comprises manipulating the upper portion of the liner string at the surface.

9. The method of claim 1 wherein the step of drilling comprises rotating the upper and lower portions of the liner string.

10. A drilling assembly for drilling a borehole with a borehole liner, the drilling assembly comprising:

an upper liner string;

a lower liner string including an upper end and a lower end;

a drilling assembly connectable at the lower end of the lower liner string;

the upper and lower liner strings and the drilling assembly being rotatable in unison with each other for drilling the wellbore;

a releasable connector connecting the lower liner string to the upper liner string, so as to enable the upper liner string to be retrieved after retrieval of the drilling assembly and the lower liner string has been cemented in the wellbore; wherein the upper liner string and the releasable connector have a drift diameter at least as large as the lower liner string; and the drilling assembly is retrievable through the upper and lower liner strings and the releasable connector.

11. The drilling assembly of claim 10 further comprising a liner hanger adjacent the upper end of the lower liner string while the upper and lower liner strings and the drilling assembly are being rotated for drilling the wellbore.

12. The drilling assembly of claim 10 wherein the drift diameter of the upper liner string is substantially the same as the drift diameter of the lower liner string.

13. The drilling assembly of claim 10 further comprising a liner hanger and wherein the releasable connector and the liner hanger are carried on a combination tool and actuation of the releasable connector allows setting of the liner hanger.

14. A method for drilling with a liner, the method comprising:

(a) connecting a drilling assembly to a liner string and lowering the drilling assembly into a wellbore;

(b) with a releasable connector, connecting a lower end of a drill string to an upper end of the liner string;

(c) rotating the drill string, the liner string, and the drilling assembly to drill the wellbore;

(d) while leaving the drill string and the liner string in the wellbore, retrieving the drilling assembly through the drill string, the releasable connector and the liner string;

(e) after retrieving the drilling assembly, pumping cement through the drill string and the liner string and up an annulus in the wellbore surrounding the liner string; and (f) after pumping the cement, disconnecting the drill string from the liner string with the releasable connector and pulling the drill string from the well, leaving the liner string cemented in the well.

15. The method according to claim 14, further comprising:

in step (b) and before step (c), attaching a liner hanger to an upper end of the liner string; and after step (d) and before step (f), actuating the liner hanger to secure the liner string to a lower end of previously installed casing.

16. The method according to claim 14, further comprising:

performing step (d) to repair or replace components of the drilling assembly prior to reaching a desired total depth for the liner string, then running the drilling assembly with repaired or replaced components back through the drill string, the releasable connector and the liner string and reconnecting the drilling assembly to the liner string to continue drilling.

17. The method according to claim 14, further comprising:

after step (d) and before step (e) running a cement float device through the drill string, the releasable connector and into the liner string; and step (e) further comprises preventing backflow of cement from the annulus with the cement float device.

18. The method according to claim 14, further comprising providing the drill string and the releasable connector with a drift diameter at least as large as a drift diameter of the liner string.

19. The method according to claim 14, wherein:

the liner string comprises tubulars having threaded ends connected to each other;

the drill string comprises tubulars having threaded ends connected to each other; and the tubulars of the drill string have drift diameters substantially the same as drift diameters of the liner string.

* * * * *